United States Patent [19]

Thompson

[11] Patent Number: 4,938,671

[45] Date of Patent: Jul. 3, 1990

[54] ROTARY ROLLER PUMP WITH COMPLEMENTARY RIBS AND GROOVES BETWEEN HOUSING, ROTOR AND ROLLERS

[76] Inventor: George A. Thompson, 114 Demotte Ave., Daytona Beach, Fla. 32019

[21] Appl. No.: 301,566

[22] Filed: Jan. 26, 1989

[51] Int. Cl.[5] ..... F04C 2/344

[52] U.S. Cl. ..... 418/178; 418/225; 418/257

[58] Field of Search ..... 418/178, 225, 253, 256, 418/257

[56] References Cited

U.S. PATENT DOCUMENTS

| | | | |
|---|---|---|---|
| 1,965,872 | 7/1934 | Webb et al. | 418/225 |
| 2,117,573 | 5/1938 | Rawls | 418/225 |
| 2,684,037 | 7/1954 | Scognamillo | 418/256 |
| 4,284,392 | 8/1981 | Pareja | 418/225 |

FOREIGN PATENT DOCUMENTS

| | | | |
|---|---|---|---|
| 354812 | 8/1931 | United Kingdom | 418/256 |

*Primary Examiner*—John J. Vrablik

*Attorney, Agent, or Firm*—Sughrue, Mion, Zinn, Macpeak & Seas

[57] ABSTRACT

A rotary pump having an eccentric rotor disposed in a cylindrical housing is provided with a pair of cylindrical roller pistons disposed in opposed recesses in the rotor for rolling engagement with the internal surface of the housing. A pair of bearing rings having radially inwardly projecting ribs are located at opposite ends of the housing with the ribs disposed in engagement with complimentary grooves formed in the external surface of the rotor and in the external surfaces of each roller to positively locate the rollers within the recesses. A plurality of bearing support members are provided having semi-circular cradle portions engaging the grooves in the rollers and parallel leg portions extending through parallel bores in the housing. Interconnecting rods are provided between the legs of opposed bearing support members to maintain the rollers in positive engagement with the internal surface of the housing at all times.

4 Claims, 3 Drawing Sheets

10
24
18
22
16
54
64
60
72
68
3.
2.
56
38
66
70
58
62
52
12
14
20

ROTARY ROLLER PUMP WITH COMPLEMENTARY RIBS AND GROOVES BETWEEN HOUSING, ROTOR AND ROLLERS

FIELD OF THE INVENTION

The present invention is directed to a rotary positive oscillating pump and more specifically to a pump having an eccentrically mounted rotor carrying a pair of oppositely disposed cylindrical pistons having axes parallel to the axis of the rotor, bearing rings in the housing cooperating with the pistons and a pair of oscillating rod bearings located within the rotor and extending between the two pistons to provide positive oscillation of the pistons relative to the rotor.

The U.S. Pat. No. to Webb et al. 1,965,872 is directed to a rotary pump having a plurality of pockets counter sunk in the periphery of a rotor and having hemispherical seats in combination with spherical sealing elements received in said seats and adapted to coact with the internal wall of the stator or housing. Connections are provided between the cup elements in which the spherical sealing elements are seated. The connections are comprised of threaded rods screwed into sockets in the cup elements and having turn buckle connections to permit adjustment of the spacing of the cup elements to compensate for wear. The rotor is provided with a hollow center for gaining access to the adjusting means.

The U.S. Pat. No. to Johnson 1,074,326 is directed to a rotary pump having a rotatable drum eccentrically mounted in a cylindrical casing and provided with pairs of divided blades or vanes which extend diametrically through the drum as spring members bearing between the divisions of the blades. Rollers are mounted on the other ends of the blades and travel in a track or runway in the casing to provide rolling contact between the blades and the casing.

The U.S. Pat. Nos. to Jackson 1,455,252 and Meyerhoefer 2,241,824 disclose rotary pumps having rotatable rotors eccentrically mounted within a cylindrical casing. The rotors are provided with a plurality of pockets for holding a plurality of cylindrical rollers having their axes parallel to the axis of the rotor. The rollers move outwardly under the influence of centrifugal force with each roller being independently mounted.

The U.S. Pat. No. to Schillinger et al 4,456,436 is directed to a rotary pump wherein the elements forming the pump rotor are constructed from a non-friction creating, long wearing material. The interior surface of the housing against which the oscillating rollers carried by the rotor are disposed in rolling relation is provided with a low friction track. The patent discloses numerous combinations of materials, but the surfaces of the track and rollers are smooth.

SUMMARY OF THE INVENTION

The present invention provides a new and improved rotary pump having a pair of opposed oscillating rollers. The rollers are provided with a pair of spaced apart circumferential grooves at opposite ends thereof for cooperation with a pair of spaced apart bearing rings on the inner surface of the housing having radially inwardly projecting ribs. A pair of oscillating rod bearings are located within the rotor in abutting relation and extend between the two pistons with each rod bearing having a curved portion disposed within one of the grooves of the piston. The foregoing combination of bearing rings and rod bearings associated with grooves in the each roller piston provide a unique bearing system which is easy to assemble and which extends the life of the pump.

The foregoing and other objects features and advantages of the invention will be apparent from the following more particular description of a preferred embodiment of the invention as illustrated in the accompanying drawings.

DETAILED DESCRIPTION OF THE INVENTION

Figure 1:
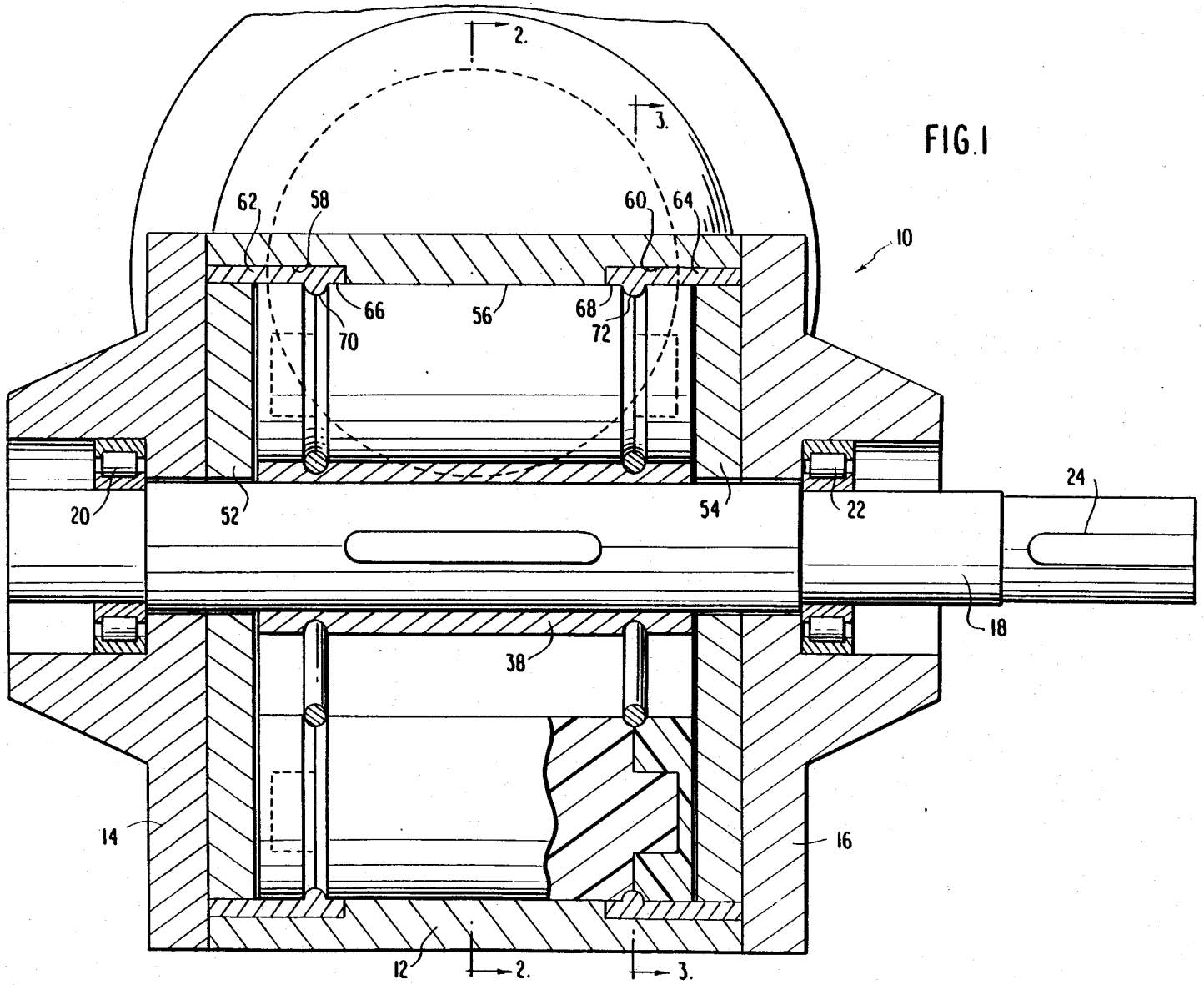
FIG. 1 is a longitudinal sectional view of the rotary pump according to the present invention.
Figure 2:
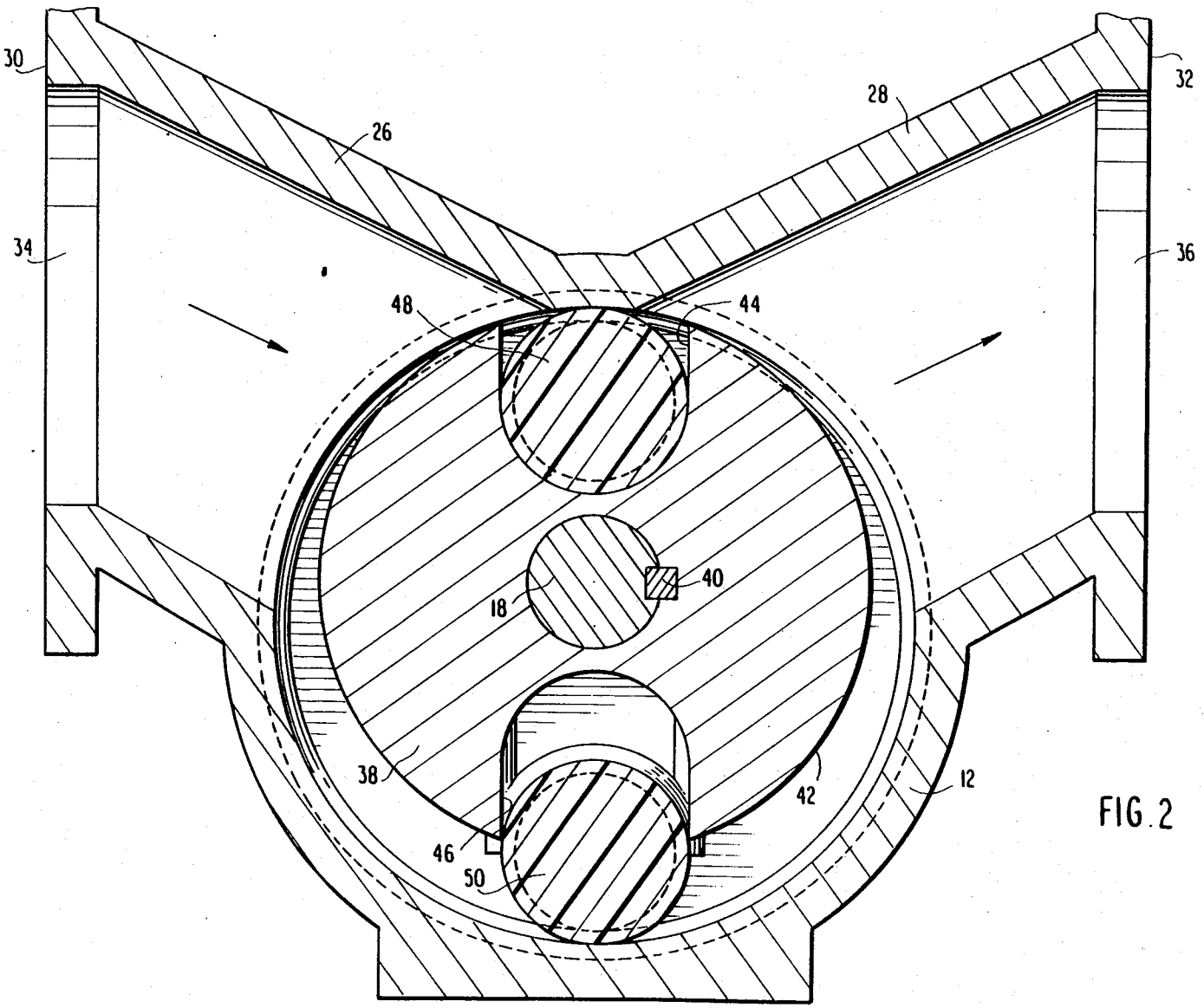
FIG. 2 is a sectional view taken along the lines 2—2 of FIG. 1.

The pump 10 according to the present invention is comprised of a substantially cylindrical housing 12 having a pair of end closure plates 14 and 16 secured to opposite ends thereof respectively, by any suitable connection such as bolts or the like (not shown). The shaft 18 is rotatably mounted within the cylindrical housing 12 with the axis of the shaft 18 being eccentrically disposed relative to the axis of the cylindrical housing 12. The shaft 18 is rotatably supported in the end housings 14 and 16 by means of bearings 20 and 22 and the shaft 18 is provided with a keyway 24 at one end thereof for connection to a motor or the like for rotating the shaft.

The housing 12 is provided with a pair of cylindrical branches 26 and 28 which communicate with the interior of the housing 12. The axes of the cylindrical branches 26 and 28 are disposed at a suitable angle to facilitate the flow of liquid into and out of the housing 12. The branches 26 and 28 are provided with attachment plates 30 and 32, respectively, defining an inlet opening 34 and an outlet opening 36 respectively.

A cylindrical rotor 38 is secured to the shaft 18 by means of a key 40 with the external surface 42 of the rotor being concentric with the axis of the shaft 18. A pair of diametrically opposed recesses 44 and 46 are formed in the circumference of the rotor 38 and a pair of cylindrical roller pistons 48 and 50 are located in the recesses 44 and 46, respectively. The bottom of each recess 44 and 46 is cylindrical to conform to the cylindrical rollers 48 and 50. The length of each roller 48 and 50 is identical to the length of each recess 44 and 46. A pair of wear plates 52 and 54 are mounted at each end of the rotor between the rotor 38 and the end housings 14 and 16.

The internal surface 56 of the housing upon which the roller pistons 48 and 50 roll is provided with a pair of circumferential recesses 58 and 60 adjacent to each end of the housing, respectively. A pair of bearing rings 62 and 64 are located in the recesses 58 and 60, respectively. The internal surfaces 66 and 68 of the bearing rings 62 and 64 are flush with the internal surface 56 of the housing with the exception of the radially inwardly protruding ribs 70 and 72 on rings 62 and 64, respectively. Each rib has a semi-cylindrical cross-sectional configuration. A pair of spaced apart annular grooves 74 and 76 are formed in the outer surface of the rotor 8 adjacent opposite ends of the rotor in alignment with the ribs 70 and 72 on the bearing rings 62 and 64. The grooves 74 and 76 have a semi-cylindrical cross-sectional configuration complimentary to the ribs 70 and 72. Likewise each roller 48 and 50 is provided with a pair of spaced annular grooves 78 and 80 which are disposed adjacent opposite ends of the rollers. The grooves 78 and 80 have a semi-cylindrical cross-sectional configuration complimentary to the ribs 70 and 72 and are disposed in alignment with the ribs. Thus, as the rotor 38 rotates relative to the housing 12, the rollers 48 and 50 will roll on the internal surfaces of the housing and the bearing rings 62 and 64 with the ribs 70 and 72 disposed in the grooves 74 and 76 on the rotor 38 and the grooves 78 and 80 on the rollers 48 and 50.

The bearing rings 62 and 64 may be of bronze or any other suitable long wearing material and the rollers 48 and 50 may be of any suitable hard, long wearing, anti-friction plastic material such as polytetrafluoroethylene or the like. The ribs 70 and 72 on the bearing rings 62 and 64 facilitate the assembly of the parts of the pump and maintain the rollers against axial movement relative to the rotor during the operation of the pump.

Figure 3:
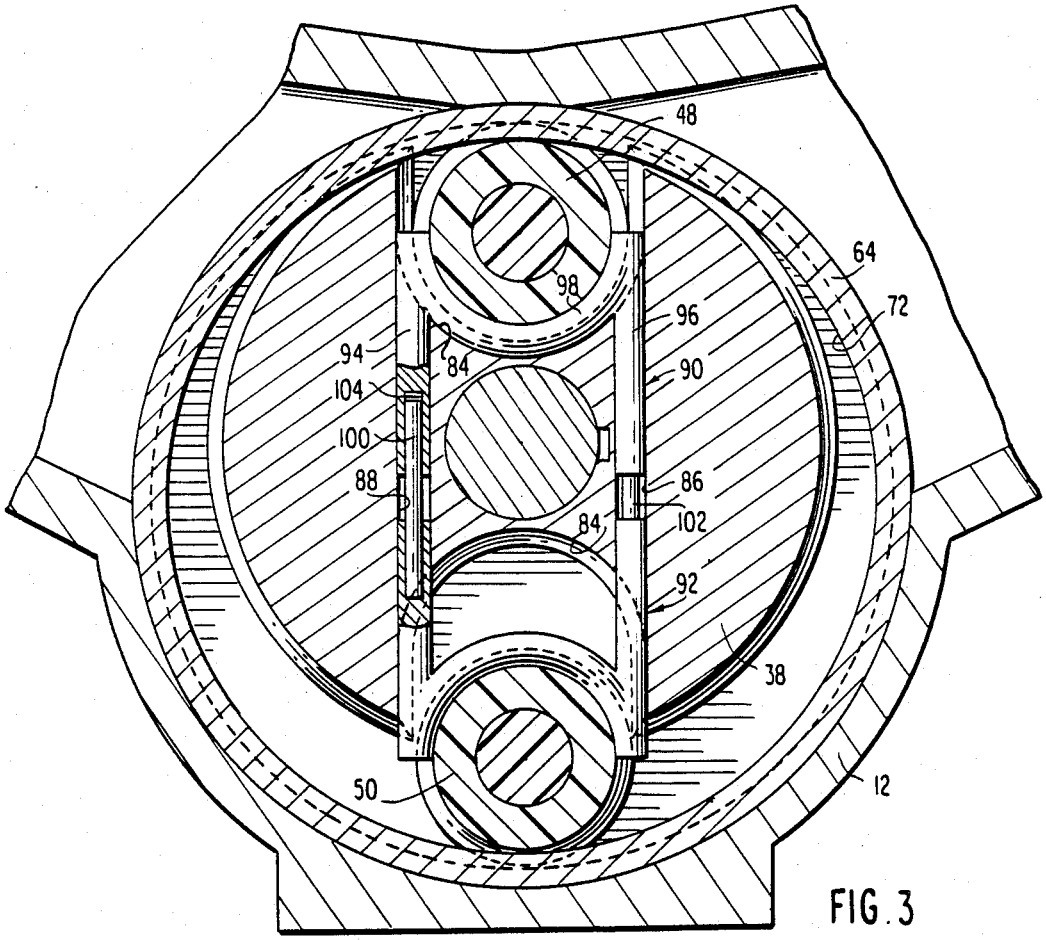
FIG. 3 is a sectional view taken along line 3—3 of FIG. 1.
Figure 4:
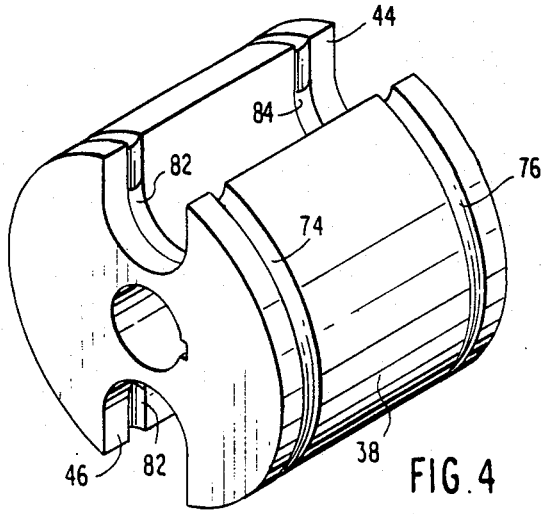
FIG. 4 is a perspective view of the rotor of the pump.
Figure 5:
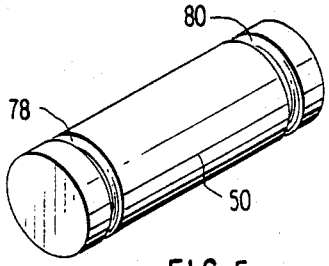
FIG. 5 is a perspective view of a roller piston.

The recesses 44 and 46 in the rotor 38 are also provided with grooves 82 and 84 which are in alignment and communication with the grooves 74 and 76 on the outer surface thereof. A pair of parallel bores 86 and 88 extend through the rotor 38 and intersect the ends of grooves 84 located in the recesses 44 and 46 as best shown in FIG. 3. Similar bores are provided through the rotor 38 adjacent the grooves 82 located in the recesses 44 and 46. A pair of bearing members 90 and 92 are associated with the grooves 84 and the bores 86 and 88. Each bearing member is comprised of two parallel leg portions 94 and 96 which extend approximately halfway into the bores 88 and 86, respectively, and a semi-circular cradle portion 98 interconnecting the ends of the rods 94 and 96. The semi-circular portion 98 has a cylindrical cross-section complimentary to the grooves 84 in the recesses 44 and 46 of the rotor and the grooves 80 and the roller piston 48. A pair of connecting rods 100 and 102 extend into opposed recesses in the ends of the legs 94 and 96 of the bearing members 90 and 92. In order to accommodate dimensional tolerances one or more shims or resilient members 104 may be located in the recesses in which the connecting rods 100 and 102 are located. Thus, a substantially rigid connection is provided between the two bearing support members 90 and 92 so that as the roller 48 is forced into the recess 44 upon rotation of the rotor 38 the roller 50 will be positively moved out of the recess 46 to maintain both rollers 48 and 50 in positive engagement with the internal surface 56 of the housing at all times. The semi-circular portions 98 of the bearing support members 90 and 92 act as supporting cradles for the rollers but do not interfere with the movement of the rollers toward the bottom of their respective recesses since the support cradles 98 are located in the complimentary grooves formed in the rollers and the recesses.

The materials used for the shaft and the housing may be of steel, aluminum or any other suitable material. While specific exemplary materials have been identified for the bearing rings 62 and 64 and the rollers 48 and 50 is obvious that other materials having similar properties could also be used interchangeably. The bearing support members 90 and 92 are preferably made of a plastic material having anti-friction properties since the roller pistons 48 and 50 rotate relative to the cradle portions 98.

While the invention has been particularly shown and described with reference to a preferred embodiment thereof, it will be understood by those in the art that various changes in form and detail may be made therein without departing from the spirit and scope of the invention.

What is claimed is:

1. A rotary pump comprising housing means having a cylindrical internal surface, a rotor rotatably mounted in said housing and having a longitudinal axis disposed eccentrically relative to the cylindrical inner surface of said housing means, a pair of diametrically opposed longitudinal recesses formed in an outer surface of said rotor, a pair of cylindrical rollers disposed in said recesses, bearing support means extending through said rotor in engagement with said rollers for positively maintaining said rollers in engagement with said cylindrical surface of said housing means at all times, bearing ring means having radially inwardly projecting rib means disposed in said housing and extending about the cylindrical inner surface of said housing and complimentary annular grooves formed in said outer surface of said rotor and outer surfaces of said rollers for engagement with said rib means.

2. A rotary pump as set forth in claim 1, wherein a pair of annular recesses are formed in the inner cylindrical surface of said housing means adjacent opposite ends thereof, respectively, and said bearing ring means is comprised of a pair of annular bearing rings of rectangular cross-section disposed in said annular recesses, respectively, each bearing ring having an internal surface disposed flush with the cylindrical inner surface of said housing means and having annular radially inwardly projecting rib means disposed thereon, and wherein said rotor and said rollers are each provided with a pair of spaced apart grooves receiving said rib means on each bearing ring.

3. A rotary pump as set forth in claim 2, wherein said rib means and said grooves have complimentary cross-sectional configurations.

4. A rotary pump as set forth in claim 2, wherein said rotor is provided with two pairs of parallel bores extending through said rotor and communicating with each recess and said bearing support means is comprised of two pairs of bearing support brackets, each bearing support bracket having a pair of spaced apart parallel leg portions extending approximately halfway through respective bores and a semi-circular cradle portion interconnecting the ends of each leg portion adjacent a respective recess with said cradle portion being disposed in a respective groove in a respective roller and interconnecting means disposed in each bore between opposed support members to maintain said rollers in engagement with the internal surface of said housing means at all times.

* * * * *